US005216413A

United States Patent [19]

Seiler et al.

[11] Patent Number: 5,216,413

[45] Date of Patent: Jun. 1, 1993

[54] APPARATUS AND METHOD FOR SPECIFYING WINDOWS WITH PRIORITY ORDERED RECTANGLES IN A COMPUTER VIDEO GRAPHICS SYSTEM

[75] Inventors: Larry D. Seiler, Boylston; James L. Pappas, Leominster; Robert C. Rose, Hudson, all of Mass.

[73] Assignee: Digital Equipment Corporation, Hudson, Mass.

[21] Appl. No.: 803,706

[22] Filed: Dec. 4, 1991

Related U.S. Application Data

[63] Continuation of Ser. No. 393,083, Aug. 9, 1989, abandoned, which is a continuation of Ser. No. 206,030, Jun. 13, 1988, abandoned.

[51] Int. Cl.[5] ..... G09G 5/14

[52] U.S. Cl. ..... 340/721; 395/164

[58] Field of Search ..... 340/721, 734, 720, 723, 340/729, 747, 701; 364/521, 522; 395/157, 158, 164

[56] References Cited

U.S. PATENT DOCUMENTS

| | | | |
|---|---|---|---|
| 4,204,206 | 5/1980 | Bakula et al. | 340/721 |
| 4,386,410 | 5/1983 | Pandya et al. | 364/518 |
| 4,412,294 | 10/1983 | Watts et al. | 364/518 |
| 4,439,760 | 3/1984 | Fleming | 340/799 |
| 4,484,187 | 11/1984 | Brown et al. | 340/703 |
| 4,496,944 | 1/1985 | Collmeyer et al. | 340/723 |
| 4,509,043 | 4/1985 | Mossaides | 340/721 |
| 4,542,376 | 9/1985 | Bass et al. | 340/724 |
| 4,545,070 | 10/1985 | Miyagawa et al. | 382/48 |
| 4,550,315 | 10/1985 | Bass et al. | 340/703 |
| 4,642,621 | 2/1987 | Nemoto et al. | 340/721 |
| 4,642,790 | 2/1987 | Minshull et al. | 364/900 |
| 4,651,146 | 3/1987 | Lucash et al. | 340/721 |
| 4,653,020 | 3/1987 | Cheselka et al. | 340/721 |
| 4,670,752 | 6/1987 | Marcoux | 340/721 |
| 4,679,038 | 7/1987 | Bantz et al. | 340/721 |
| 4,688,033 | 8/1987 | Carini et al. | 340/800 |
| 4,694,288 | 9/1987 | Harada | 340/747 |
| 4,700,320 | 10/1987 | Kapur | 364/521 |
| 4,710,761 | 12/1987 | Kapur et al. | 340/721 |
| 4,710,767 | 12/1987 | Sciacero et al. | 340/723 |
| 4,716,460 | 12/1987 | Benson et al. | 358/140 |
| 4,720,803 | 1/1988 | Ishii | 364/521 |
| 4,727,425 | 2/1988 | Mayne et al. | 358/80 |
| 4,736,200 | 4/1988 | Ounuma | 340/734 |
| 4,751,446 | 6/1988 | Pineda et al. | 340/703 |
| 4,752,893 | 5/1988 | Guttag et al. | 364/518 |
| 4,769,762 | 9/1988 | Tsujido | 340/721 |
| 4,772,881 | 9/1988 | Hannah | 340/703 |
| 4,774,678 | 9/1988 | David et al. | 364/518 |
| 4,779,081 | 10/1988 | Nakayama et al. | 340/721 |
| 4,791,580 | 12/1988 | Sherrill et al. | 364/521 |
| 4,800,380 | 1/1989 | Lowenthal et al. | 340/750 |
| 4,801,930 | 1/1989 | Tsuchiya et al. | 340/703 |
| 4,808,989 | 2/1989 | Tabata et al. | 340/750 |
| 4,812,996 | 3/1989 | Stubbs | 364/487 |
| 4,815,010 | 3/1989 | O'Donnell | 364/521 |
| 4,815,012 | 3/1989 | Feintuch | 364/521 |
| 4,823,108 | 4/1989 | Pope | 340/721 |
| 4,823,303 | 4/1989 | Terasawa | 364/521 |
| 4,829,294 | 5/1989 | Iwami et al. | 340/723 |
| 4,862,154 | 8/1989 | Gonzalez-Lopez | 340/747 |
| 4,864,517 | 9/1989 | Maine et al. | 364/521 |
| 4,868,552 | 9/1989 | Chang | 340/721 |
| 4,876,533 | 10/1989 | Barkins | 340/721 |
| 4,894,653 | 1/1990 | Frankenbach | 340/703 |

*Primary Examiner*—Jeffery A. Brier

*Attorney, Agent, or Firm*—Arnold, White & Durkee

[57] ABSTRACT

A method and a device for distinguishing which pixels are to be displayed in a set of overlapping, rectangular windows in video graphics display are provided. Windows are specified as a priority ordered list of rectangles or other shapes, so that each window is computed as being visible at those pixels that are inside its rectangle but outside the rectangles of all higher priority windows. The number of rectangles required is equal to the number of rectangular windows, irrespective of the degree of overlap.

12 Claims, 5 Drawing Sheets

APPARATUS AND METHOD FOR SPECIFYING WINDOWS WITH PRIORITY ORDERED RECTANGLES IN A COMPUTER VIDEO GRAPHICS SYSTEM

This application is a continuation of application Ser. No. 393,083, filed Aug. 9, 1988 now abandoned, which is a continuation of Ser. No. 206,030, filed Jun. 13, 1988 now abandoned.

RELATED APPLICATIONS

This invention is related to the following applications, all of which are assigned to the assignee of the present invention and concurrently filed herewith in the names of the inventors of the present invention:

Semaphore Controlled Video Chip Loading in a Computer Video Graphics System, Ser. No. 206,203 now U.S. Pat. No. 5,058,041.

Pixel Lookup in Multiple Variably-Sized Hardware Virtual Colormaps in a Computer Video Graphics System, Ser. No. 206,026 now U.S. Pat. No. 5,025,249.

Datapath Chip Test Architecture, Ser. No. 206,194 now U.S. Pat. No. 4,929,889.

Window Dependent Pixel Datatypes in a Computer Video Graphics System Ser. No. 206,031.

BACKGROUND OF THE INVENTION

This invention relates generally to the field of computer video display systems. More particularly, this invention relates to a computer video graphics system capable of displaying multiple overlapping windows on a priority ordered basis.

In computer video graphics systems, a monitor displays frames of information provided by a frame buffer many times a second. The subsystem of a video graphics system between the frame buffer and the monitor is called the video datapath. As the format and content of video data becomes increasingly complex, the capability of video displays increases. For example, providing the feature of windows in graphics systems increases the demand on and complexity of the video datapath. The complexity of the system is further increased where multiple overlapping windows are called for.

Modern graphics workstations require that multiple windows be present on the display screen at once. Different windows typically contain data from different sources, that may need to be displayed using different colormaps or with other differences in the pixel processing in the video datapath. Additionally, drawing operations to different windows must be clipped so as to not draw outside the window boundaries and not draw into overlapping windows of higher priority. In most graphics workstations, windows are constrained to be rectangular. However, due to overlaps, the visible portion of a window need not be rectangular.

The standard art in the workstation industry at present is for multiple windows to all use the same pixel processing in the video datapath, so that only one colormap is used at a time, and the entire display uses either full color or pseudocolor at the same time, if it is possible to select between them at all.

For clipping drawing operations to the frame buffer, the standard art is a purely software approach of breaking up each window into simple non-overlapping regions. Scanlines and rectangles are the usual shapes that are used. Individual drawing operations are then clipped against these shapes when drawing to an individual window.

Other known systems allow different windows to use different colormaps at the same time. This is provided by coding the window number into dedicated planes of frame buffer memory. The per-pixel window number is also used to clip drawing operations to the frame buffer, although with the disadvantage that each frame buffer write must be preceded by a read to check the window number. This is a costly approach, suitable only for high end workstations.

In other known workstations, a set of non-overlapping rectangles to select windows from different parts of the frame buffer are used. This allows the workstations to store windows in the frame buffer independent of where they are displayed on the screen. However, their data structure requires that software compute lists of non-overlapping regions for each window, and places a limit on the number of regions that can occur on a single scanline. Also, the total number of windows on the screen is limited to the number of windows that can be stored in the frame buffer without occlusion. In a heavily occluded multi-window display, this is a significant drawback.

Various products and graphics chips have allowed a single window, or a small number of non-overlapping windows, to be overlaid onto the screen background. For example, a known system uses a chip to allow a single window to be overlaid on top of the rest of the screen at an arbitrary position. Other known systems restrict the positions allowed for the overlapping windows.

It is desirable to provide an efficient way to specify regions on the display screen that are parts of different windows. The regions may be specified as a priority ordered list of overlapping rectangles or other shapes.

It is also desirable to provide an efficient means for distinguishing which pixels are part of each of a set of overlapping, rectangular windows. The windows may be specified as a priority ordered list of rectangles, so that each window is computed as being visible at those pixels that are inside its rectangle but outside the rectangles of all higher priority windows. The number of rectangles required is always equal to the number of rectangular windows, irrespective of the degree of overlap.

It is also desirable to allow multiple window regions to be specified on the display screen using an efficient representation. The amount of data required to represent the windows should depend only on the number of windows—not on the relative positions of or overlap between the windows.

It is also desirable to allow the window region containing each pixel on the screen to be computed at video refresh rates. This is necessary in order to support pixel processing in the video datapath that is different for different windows.

Examples of different processing that may be carried out for different windows in the video datapath include colormap selection, double buffer selection, and pixel datatype (e.g., full color or pseudocolor). Window containment can also be used to control clipping when drawing to the frame buffer.

SUMMARY OF THE INVENTION

The present invention is generally directed to solving the foregoing and other problems, as well as satisfying the recited shortcomings of known computer graphics systems.

In a preferred embodiment of the present invention, the priority ordered rectangle list exists in a set of hardware registers. All windows are compared to the current position of the video monitor refresh process for each pixel, and a priority tree finds the highest priority window that contains the pixel. This allows window containment to be computed at video refresh rates.

This invention comprises three basic logic elements: the pixel addressing logic, the rectangle registers, and the window number priority tree.

The pixel addressing logic specifies the pixel for which a window number is to be computed. This address is specified as an x,y pair. When computing window containment for a video datapath, the pixel addressing logic is a pair of counters, with y cleared by end of frame (i.e., the last pixel of the last scanline to be displayed) and incremented by end of line, and with x cleared by end of line and incremented on each clock cycle. When computing clipping for frame buffer accesses, the address comes from the pixel drawing logic.

The rectangle registers specify the regions occupied by each of the windows, as minimum and maximum x and y values. The unoccluded shape of each window is broken into one or more rectangles. These rectangles are then stored in the rectangle registers before the rectangles for all lower priority windows and after the rectangles for all higher priority windows. Associated with each rectangle register is a comparator that decides whether the currently addressed pixel is or is not within the specified rectangle. A number of techniques are available to optimize this comparison, given the sequential nature of most accesses.

The window number priority tree determines which window contains each pixel. This window number is built up one bit at a time. At the first level of the priority tree, the containment signals from adjacent pairs of rectangle registers are compared. If either or both contains the current pixel, a containment signal is output to the next tree level and the LSB is set to the containment bit of the higher priority rectangle. The same processing occurs at subsequent levels, except that the containment bit of the higher order set of rectangle registers also selects which inputs to use as the low order window number bits.

The window number priority tree produces a window number and a containment bit. If the containment bit is set, the pixel is within the rectangle for the specified window, but no higher priority rectangle. If the containment bit is low, then the addressed pixel is not in any of the rectangles. In that case, the window number to use is taken from a special "background window" register. When all of the rectangles implemented in the video graphics system of the present invention are used up, remaining windows all share the same window number as one of the allocated windows. Distinct window numbers, and therefore distinct colormaps and pixel datatypes, are only available for the higher priority windows on the screen.

This invention computes the areas covered by overlapping windows directly from their rectangular regions, without requiring storage of the sub-rectangles that are actually visible for each occluded window. So the number of windows supported is independent of their placement on the screen. The priority tree allows a large number of window rectangles to be supported—64 in a preferred embodiment, although more can be supported.

This invention computes the number of the window containing each pixel at video refresh rates, which allows different windows to use different visual display attributes, such as different colormaps and different pixel datatypes. A background window number can be explicitly specified for pixels that fall outside all of the priority order rectangles. This allows all remaining windows to share a set of default visual attributes.

Finally this invention can be applied to clipping frame buffer drawing operations. Drawing addresses can be compared to the priority rectangles in order to determine whether a given drawing operation is inside or outside of its window.

BRIEF DESCRIPTION OF THE DRAWINGS

The above-noted and other aspects of the present invention will become more apparent from a description of the preferred embodiment when read in conjunction with the accompanying drawings.

The drawings illustrate the preferred embodiment of the invention, wherein like members bear like reference numerals and wherein.

DESCRIPTION OF A PREFERRED EMBODIMENT

Figure 1:
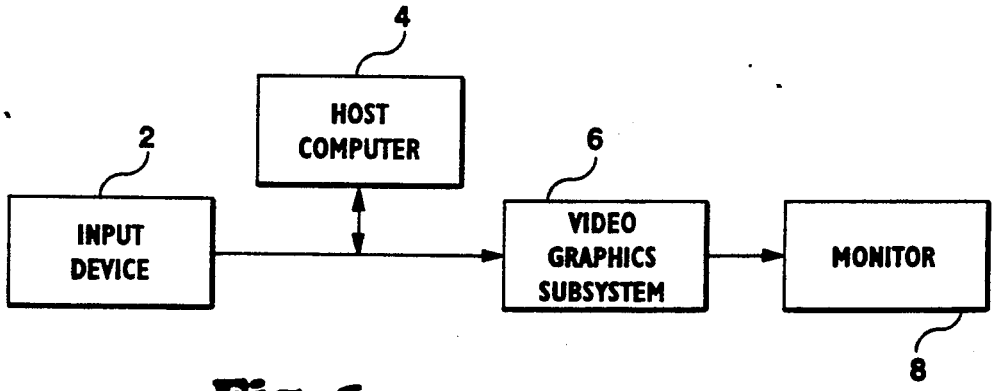
FIG. 1 is a general block diagram of a computer video graphics system employing the invention.

Referring to FIG. 1, a general block diagram of a video graphics system which employs the present invention is shown. An input device 2 functions as the means by which a user communicates with the system, such as a keyboard, a mouse or other input device. A general purpose host computer 4 is coupled to the input device 2 and serves as the main data processing unit of the system. In a preferred embodiment, the host computer 4 employs VAX architecture, as presently sold by the assignee of the present invention. A video graphics subsystem 6 receives data and graphics commands from the host computer 4 and processes that data into a form displayable by a monitor 8. The video graphics subsystem 6 features the use of large volume state tables for storing state data. According to the invention, the video graphics subsystem 6 is specially adapted to provide for displaying a number of overlapping windows on a priority ordered basis. In a preferred embodiment, the monitor 8 is an RGB CRT monitor.

Figure 2:
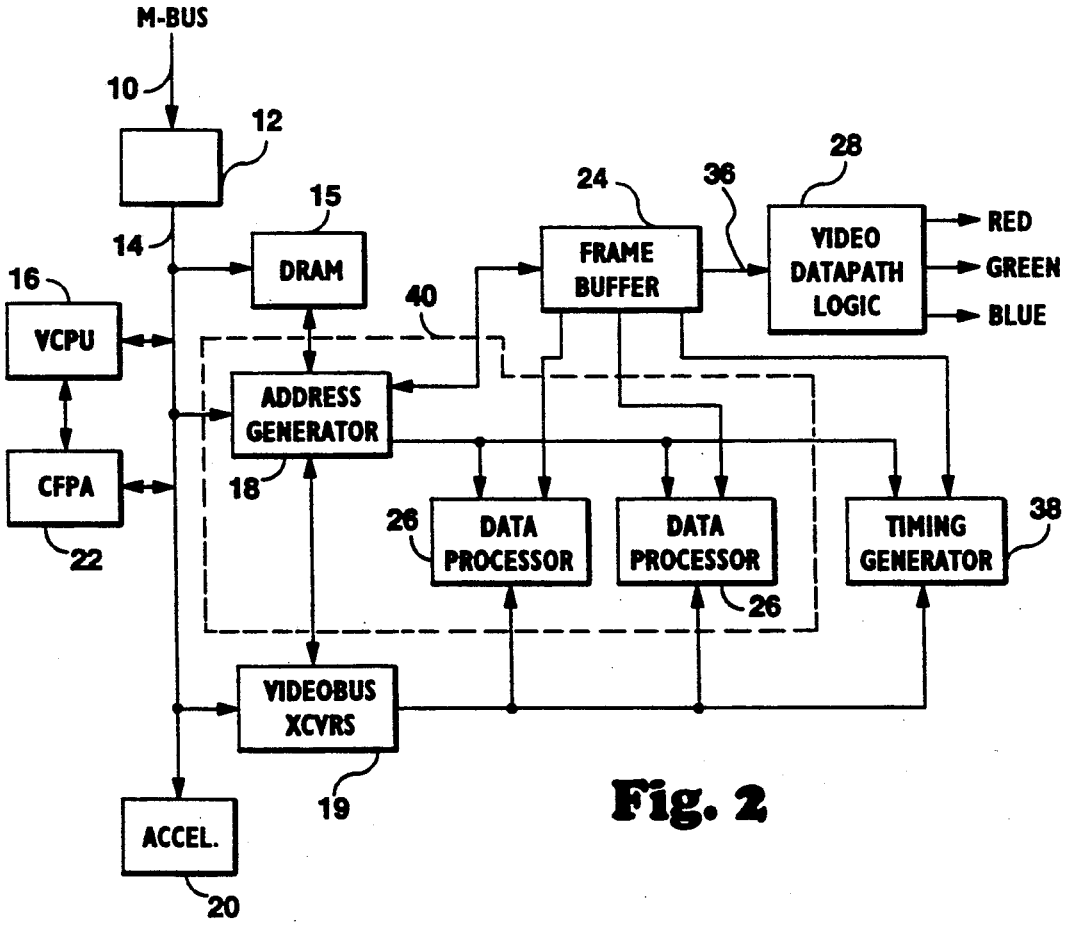
FIG. 2 is a block diagram of a system employing the present invention.

Referring now to FIG. 2, an embodiment of a video graphics subsystem 6 which employs the present invention is shown. This graphics subsystem is an interactive video generator which may be used for two-dimensional (2D) and three-dimensional (3D) graphics applications.

The graphics subsystem 6 receives graphics commands and data from the host Central Processing Unit (CPU) in the host computer 4 by way of a memory bus (M-Bus) 10. The host CPU communicates with a video graphics subsystem bus (VI-Bus) 14 by way of an interface 12. The interface 12 performs all functions necessary for synchronous communication between the M-Bus 10 of the host CPU and the VI-Bus 14 of the graphics subsystem 6. The interface 12 is of conventional design and decodes single transfer I/0 read and write cycles from the M-Bus and translates them into VI-Bus cycles for the graphics subsystem in a manner known in the art. The interface 12 also supports Direct Memory Access (DMA) transfers over the M-Bus 10 between the workstation main memory in the host computer 4 and a video graphics system dynamic random access memory (DRAM) 15. DMA transfer is a technique known in the art whereby a block of data, rather than an individual word or byte, may be transferred from one memory to another.

A graphics subsystem CPU (VCPU) 16 is provided as the main processing unit of the video graphics subsystem 6. All requests by the host CPU for access to the graphics subsystem (via the M-Bus10/interface 12) go through an address generator 18 which serves as the arbitrator for the VI-Bus 14. There are three possible masters seeking access to the VI-Bus 14: the VCPU 16, the interface 12 and an accelerator 20. The address generator 18 grants bus mastership on a tightly coupled, fixed priority basis. The VCPU 16 is the default bus master. The accelerator 20 serves as a co-processor with the VCPU 16.

The VCPU 16 also employs a floating point unit (CFPA) 22. The VCPU 16/CFPA 22 form the main controller of the graphics subsystem 6. This combination loads all graphics data to the graphics subsystem, provides memory management, an instruction memory, and downloads the initial code store of the accelerator 20.

As used herein, the term graphics rendering is understood to mean the process of interpreting graphics commands and data received from the host CPU 4 and generating resultant pixel data. The resultant pixel data is stored in so-called on-screen or off-screen memory in a frame buffer 24. The graphics rendering section of the graphics subsystem is implemented in the address generator 18 and a set of data processors 26. These logic elements translate addresses received from the host CPU 4 into pixel data addresses and manipulate pixel data. The address generator 18 and the data processors 26 make up a pixel drawing engine 40. Video bus transceivers (XCVRs) 19 perform a read/write function to accommodate the additional load on the VI-Bus 14 by the data processors 26 and the timing generator 38.

Figure 3:
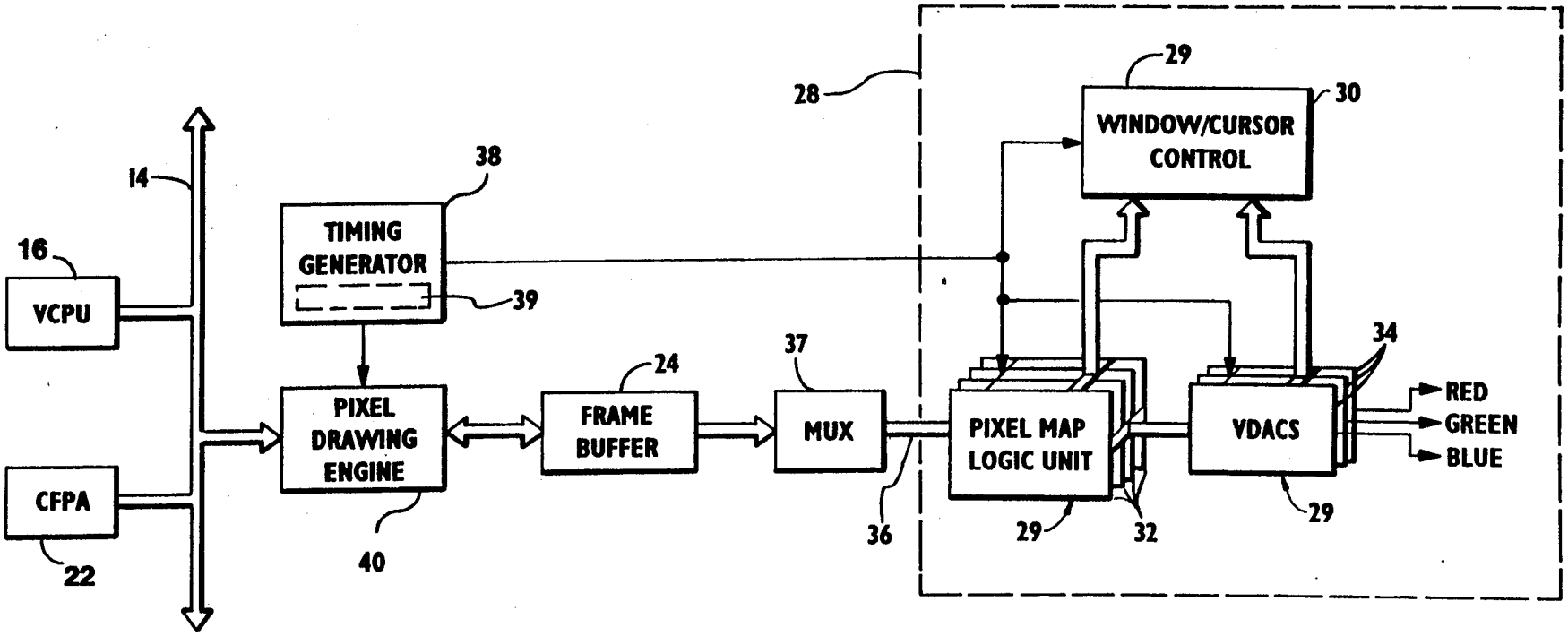
FIG. 3 is a block diagram of a video graphics subsystem employing the present invention.

As used herein, the term graphics display is understood to refer to the process of outputting the pixel data from the frame buffer 24 to a viewing surface, preferably the monitor 8. A video graphics datapath logic section 28 of the graphics subsystem of FIG. 2 is provided. Referring to FIG. 3, the logic section 28 comprises a window/cursor control 30, a set of pixel map logic units 32 and a set of digital to analog converters (VDACs) 34. Collectively, the window/cursor control 30, the pixel map logic units 32 and the VDACs 34 may be referred to hereinafter as the video graphics or data path logic units 29. In a preferred embodiment, one window/cursor control 30, four pixel map logic units and three VDACs 34 are provided and each of these data path logic units is implemented on a single integrated circuit chip. The video graphics data path logic section 28 defines the windows on the screen and determines the source within the frame buffer 24 which will provide the pixel data for the current window. The video graphics data path logic section 28 also converts the digital information in the video graphics subsystem to an analog form to be displayed on monitor 8. This data includes bitmap memory, overlay plane and cursor, as described more fully with relation to FIGS. 4–6.

FIG. 3 depicts a preferred embodiment of the present invention for loading data into data path logic unit registers (state tables) in the video data path logic section 28. These data are stored in so-called off-screen memory of the frame buffer 24 and are loaded automatically into the window/cursor controls 30, the pixel map logic units 32 and the VDACs 34 by the screen refresh process starting after the last displayable scan. Data for the data path logic units 29 are sequentially loaded through one of a set of four-bit inputs 36 starting with the least significant bit ("LSB") of the first data path logic unit register ("register <0>") in the data path proceeding through the most significant bit ("MSB") of the last register of the last data path logic unit 29. There are also as many inputs 36, each four bits wide, as there are bits in a pixel; for example, if 24 bits define a pixel, there will be 24 such inputs 36. There may also be additional inputs 36 to accommodate cursor data and overlay plane data as described below. A multiplexer 37 takes the data in the frame buffer 24 and feeds this data to the data path logic units 29 serially. Logic (not shown) generates the sequential addresses for the various registers in the data path logic units 29 in a manner known in the art.

A timing generator 38 is provided to control the loading and output of display data in the on-screen memory of frame buffer 24, the loading of data in the off-screen memory for the video output logic section 28 and the generation of timing signals for the monitor 8. Off-screen memory of the frame buffer 24 includes a copy of the data in the state tables of the data path logic units 29. The timing signals for the monitor 8 include conventional horizontal and vertical synchronization (sync) and blank signals.

Figure 4:
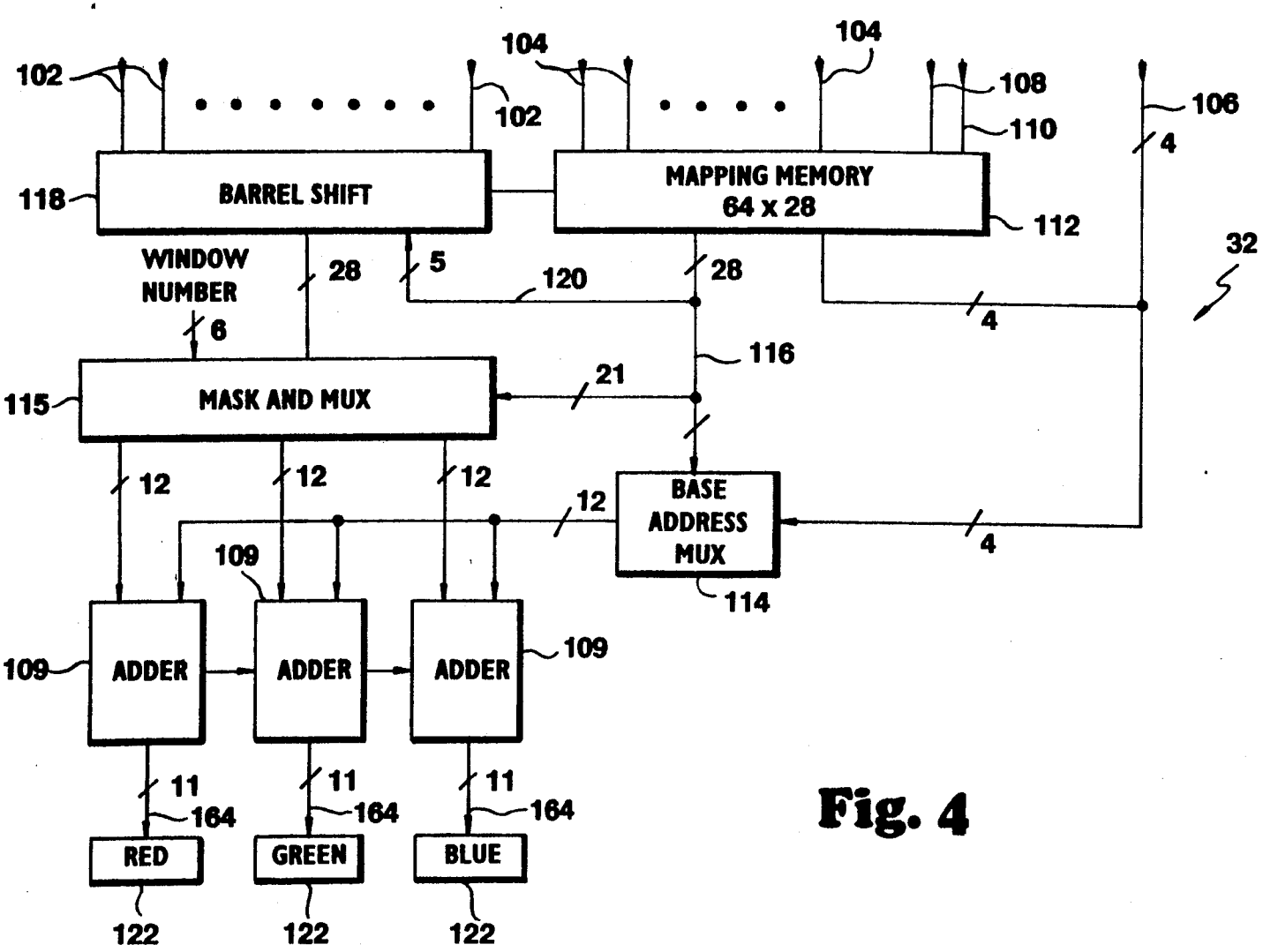
FIG. 4 is a block diagram of a pixel map logic unit which is employed to carry out the present invention.

Referring to FIGS. 3 and 4, the system timing generator 38 generates a LOAD signal 108 and an INHIBIT signal 110 and has an interface to the VCPU 16. Before the LOAD signal 108 is asserted, the timing generator 38 checks a semaphore register 39. If the VCPU 16 has the semaphore (i.e., update of the data path state tables is in progress), the INHIBIT signal 110 is asserted with the LOAD signal 108, thus preventing the reading of the off-screen memory of frame buffer 24 into the data path state tables during that vertical retrace. The INHIBIT signal 110 remains asserted for the entire interval during which the VCPU updates the copy of the state tables in off-screen memory of frame buffer 24. The data path logic units keep their previous state table values, which were valid. Since the data path logic units continue to use a set of valid values, a screen glitch is prevented.

If the VCPU 16 does not have the semaphore when the timing generator 38 is ready to assert the LOAD signal 108, then the timing generator 38 claims it and keeps it until vertical retrace is over. The VCPU 16 must then wait until the reading of the off-screen memory of frame buffer 24 into the data path logic units 29 is complete before it begins modifying the off-screen memory of frame buffer 24.

Figure 5:
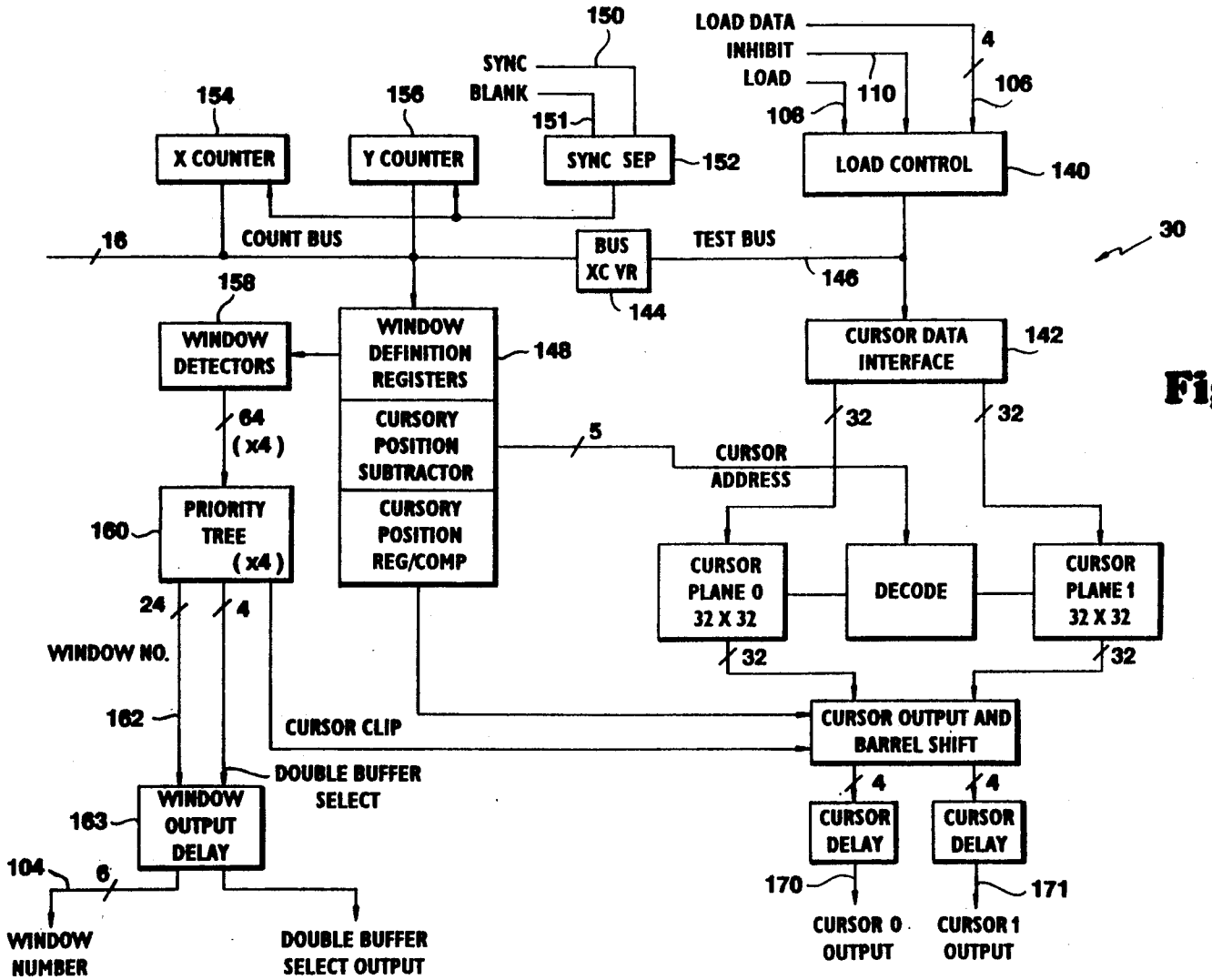
FIG. 5 is a block diagram of a window/cursor control which is employed to carry out the present invention.
Figure 6:
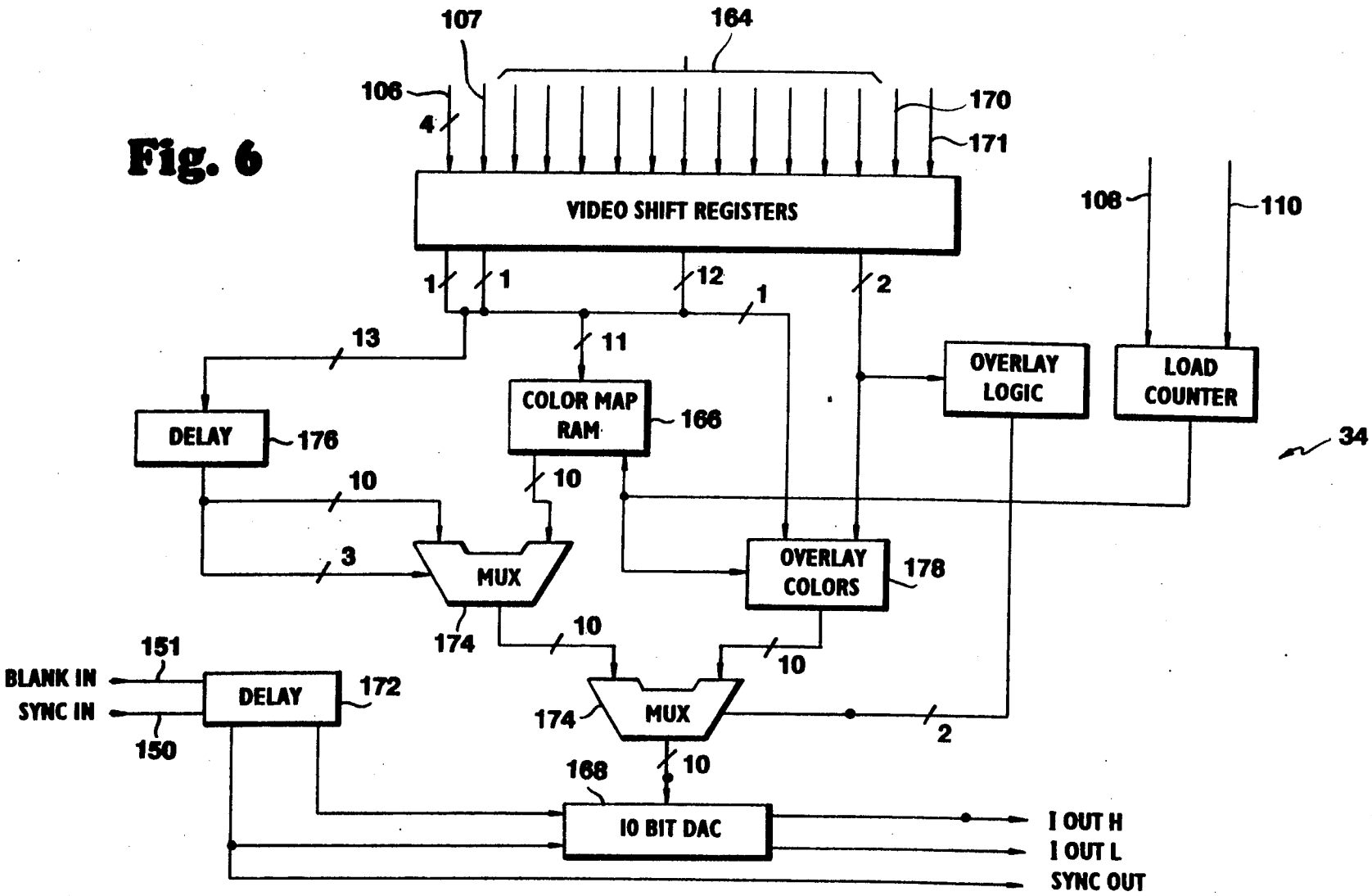
FIG. 6 is a block diagram of a video colormap/digital to analog converter which is employed to carry out the present invention.

Referring now to FIGS. 4, 5 and 6, a preferred embodiment of the present invention is illustrated. Bit sizes of the various buses and registers, shown in the conventional manner, are exemplary only, and are not by way of limitation. It is to be understood that FIGS. 4, 5 and 6 illustrate the primary flow paths of data and are not intended to illustrate all control lines. For example, for proper operation, the various circuit components are presumed to be provided with a proper clock signal in a conventional manner.

FIG. 4 illustrates a preferred embodiment of the pixel map logic unit 32. Pixel data from the on-screen memory of frame buffer 24 via multiplexer 37 is input to the pixel map logic unit via a set of data input lines 102. The data input lines 102 carry sufficient bits to define a pixel, in a preferred embodiment 24 bits. The number of bits in the data input lines 102 equals the number of planes in the frame buffer 24. In a preferred embodiment, a 24 plane frame buffer provides 24 bits per pixel.

The pixel map logic unit 32 is provided with a window number input 104. The window number input 104 carries sufficient bits to select one of a plurality of windows, such as for example, 64 windows. The window number input 104 provides a window number from the window/cursor control 30, an embodiment of which is shown in FIG. 5 and described below. The LOAD input 108 and the INHIBIT input 110 are provided to control the loading of data into the various registers in the pixel map logic unit 32. A load data input 106 provides the data from the off-screen memory of the frame buffer 24 via multiplexer 37 to be loaded into the various registers under the control of the LOAD input 108 and the INHIBIT input 110.

On each clock pulse, a pixel value at the pixel data input lines 102 and a window number at the window number input 104 are input into the pixel map logic unit 32. The window number input 104 determines how the pixel values at the pixel input lines 102 are arranged to form a set of three 11 bit index values 164. The mapping information is stored in a mapping memory 112, one of the pixel map logic unit's state tables, which is addressed by the window number input 104.

As understood from FIG. 4, the load data input 106 loads the mapping memory 112. In a preferred embodiment, the mapping memory 112 contains register space for 64 mapping configuration words, one mapping configuration word for each possible window. The mapping configuration words and their use in a preferred embodiment are explained more fully below.

In loading the mapping memory 112, the load data input 106 provides a base value to the mapping memory which is output for each pixel to a base address multiplexer (MUX) 114. The pixel map logic unit 32 processes pixel data from the frame buffer 24 according a specified pixel datatype for each window. The processed pixel value produced in the pixel map logic unit 32 is then converted into an index into a physical colormap in the VDACs 34. These index values are indicated in FIG. 4 as set of index values 164 and are input into the VDACs 34 as shown in FIG. 6. This conversion is accomplished by adding a base value from the base address MUX 114 to the pixel value in a set of adders 109. The base value is selected based on the window containing this pixel. The pixel value is therefore a relative index into a window's virtual colormap, which is pointed to by the base value.

One example of the mapping configuration word is as follows:

| 2 \| 2 | 2 \| 2 | 2 \| 1 | 1 \| 1 | 1 \| 1 | 0 |
|---|---|---|---|---|---|
| 7 \| 6 | 5 \| 4 | 0 \| 9 | 6 \| 5 | 2 \| 1 | 0 bit |
| V\| Mod | \| Shift | \|Mask | \|# Planes | \|Base Value | field |

The mapping configuration word is broken into fields as shown to control the various sections of the pixel map logic unit 32. One of the mapping configuration words is output from the mapping memory 112 onto the mapping configuration word bus 116. The "shift" field, as shown in the above example, carries, for example, 5 bits which are input into a barrel shift 118 via a shift bus 120. The barrel shift 118 shifts each pixel value by a number of bits equal to the digital value on the shift bus 120. Shifting each pixel value in this way permits, for example multiple windows to take bits from different parts of the same pixel.

Referring now to FIG. 5, the Window/Cursor Control 30 which may be employed in carrying out the present invention is shown. The window/cursor control 30 provides two basic functions, hardware window support and hardware cursor support.

As with the pixel map logic unit 32, the window/cursor control 30 is responsive to the LOAD input 108 and the INHIBIT input 110. When the VCPU 16 captures the semaphore as stored in the register 39 in the timing generator 38, the LOAD input 108 goes to a high state enabling update of the state tables 29 of the window/cursor control 30. This LOAD signal is triggered by the video graphics subsystem's vertical sync so that update occurs only during vertical retrace. If more data must be loaded into the state tables 29 of the window/cursor control 30 than can be loaded in one vertical retrace, then, just before the vertical retrace is complete, the INHIBIT input goes to a high state pausing the loading of the state tables.

Also as with the pixel map logic unit 32, data is loaded into the window/cursor control 30 by way of the load data input 106. The load data input 106 inputs data into a LOAD Control 140 which either enables or disables the loading of data as indicated by the value in the semaphore register 39. If the semaphore indicates that data is to be loaded, the data is sent to a cursor data interface 142 or to a Bus Transceiver (XCVR) 144 as dictated by the internal logic of the window/cursor control 30 in a manner known in the art. A test bus 146 is provided, and it is a bi-directional bus. The bus transceiver 144 permits data to be sent from the test bus 146 to a set of window definition registers 148 or to permit the data from the window definition registers 148 to be written onto the test bus 146.

A Sync input 150 provides a composite signal which includes information about the horizontal and vertical sync signals of the video graphics subsystem 6. A Sync separator (Sync Sep) 152 is provided to separate the vertical and horizontal sync signals to provide clock signals to an X counter 154 and to a Y counter 156. Thus, the window/cursor control 30 calculates the position of the CRT refresh logic for the monitor 8 via a set of internal X and Y counters. By using the monitor's sync signal via the sync input 150 and the monitor's blank signal via blank input 151, the window/cursor control 30 is able to keep these counters synchronous with the refresh and retrace cycles of the monitor 8. At all times, the values of the X Counter 154 and the Y Counter 156 correspond with the actual refresh process on the CRT 8. On every clock cycle, these counter values are compared with the programmed cursor position and all of the window definition registers 148. The window definition registers 148 store the minimum and maximum x and y values of each window defined, effectively storing the locations of the edges of the windows. Each minimum and maximum x and y value is independent of any other so that overlapping windows may be defined. The origin is in the upper left, with increasing X values to the right and increasing Y values downward.

The window/cursor control 30 has two primary sections, a cursor section which comprises the cursor data interface 142 (and the elements that it communicates with) and a window section which comprises the bus XCVR 144 (and the elements that it communicates with). The window section computes three sets of outputs. The first is the window number which for each pixel, is sent to the pixel map logic units 32. Next, the window/cursor control 30 computes a double buffer select signal which is used to select one of two banks of RAM chips to enable double buffering on a per window basis. The final value that the window/cursor control 30 computes is used internally as clipping information for the cursor and is used to allow the cursor to appear in selected windows. This feature may be used when displaying a hairline cursor in a window. This signal will clip the cursor allowing it to appear only in unoccluded portions of selected windows.

The cursor section computes two values, a cursor 0 output 170 and a cursor 1 output 171. These values are input to VDACs 34 as an index into a hardware colormap as described with regard to FIG. 6 and generate a sprite cursor in a manner known in the art.

The window definition registers 148 send window definitions to a set of window detectors 158. If two or more windows overlap, then the overlap will encompass pixels within both windows. The window definition registers 148 thereby provide a means for assigning priority to each window. The window detectors 158 in turn provide window descriptions to a priority tree 160. The priority tree 160 determines, of those windows defined, which are the highest priority for each pixel. In other words, if window A and window B overlap and window A covers up part of window B, window A has the higher priority and will be assigned on a window no. output 162. If a particular pixel is not contained in any window, default window mapping is output as a background. The priority tree also sends cursor clipping information to a cursor output unit 173 so that the cursor will not appear in occluded portions of selected windows as described above.

Referring to FIG. 6, one example of the VDAC 34 which employs the present invention is shown. One such VDAC 34 is provided for each of the red, green and blue channels of the monitor 8. The VDAC 34 includes the LOAD input 108 and the INHIBIT input 110 to control updating the various registers of the VDAC 34 as previously described.

The pixel map logic units 32 provide the set of index values 164 for each of the red, green and blue channels of the VDAC 34. Each of the index values 164 is four bits wide (one bit from each of the four pixel map logic units 32). Since each index value 164 indexes a location into a color map RAM 166, each window can use a different portion of color map RAM 166, and each window is provided with full color independently of other windows. Similarly, cursor 0 input 170 and cursor 1 input each indexes its own location into an overlay colors register 178 to provide for a three colored cursor that can therefore be seen against any color of background or window. Each bit is then routed via a set of multiplexers 174 to a DAC 168 where it is converted to an analog value which drives either the red, green or blue channel of the monitor. The blank signal via blank input 151 and sync signal via sync input 150 are input to adjustable delay 172 to compensate for other delays in the video graphics subsystem. The mapping scheme as herein described can be optionally disabled by map enable input 107. Asserting map enable input 107 bypasses color map RAM 166 through delay 176 which provides sufficient delay to match that of color map RAM 166. In a preferred embodiment, the DAC 168 is capable of driving a one volt ground referenced RS343 compatible video into a 75 ohm cable.

Cursor 0 input 170 and cursor 1 input 171 are used to select pixel by pixel between video data or three overlay colors. When both cursor 0 input 170 and cursor 1 input 171 are zero, the video data is selected. The three other input states select one of three overlay color registers in the overlay colors register 178. The overlay colors register 178 is updated by data from the load data input 106 under the control of the LOAD input 108 and the INHIBIT input 110. Thus, a cursor may have colors different from all the colors in the color map RAM 166.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A clocked computer video graphics system for displaying on a monitor pixels belonging to overlapping windows, comprising:

a. a frame buffer for sequentially and continuously providing pixel values to the system from the first memory location in the frame buffer to the last memory location in the frame buffer to be interpreted for display;

b. means for assigning a priority to each window to be displayed;

c. window definition registers for specifying the pixels within each window;

d. a set of counters coupled to the window definition registers for tracking the x and y values of the pixel being displayed at any time;

e. a comparator for determining if the pixel specified by said counters is within each window for each clock pulse of the system; and f. an arbitrator for selecting the highest priority window of those which the pixel is within.

2. The graphics system according to claim 1 and including a monitor and means for displaying the pixels on the monitor.

3. The graphics system according to claim 1 wherein said highest priority window is used to clip drawing operations to the frame buffer.

4. The graphics system of claim 2 further comprising a means for assigning a default window number to each pixel value for which no bit was produced by the comparator.

5. The video graphics system of claim 1, wherein the arbitrator comprises a priority tree for determining which of the windows containing each pixel has highest priority.

6. The video graphics system of claim 1, wherein the frame buffer stores pixel values as overlapping windows.

7. In a computer video graphics system having a pixel processing unit and a frame buffer with memory locations and which is capable of displaying pixels sequentially and continuously from the first memory location in the frame buffer to the last memory location in the frame buffer in a plurality of windows of selectable priority, a method of determining a window number for each said pixel comprising the steps of:

a. sequentially and continuously obtaining pixel values from the first memory location in the frame buffer to the last memory location in the frame buffer;

(b) providing respective window numbers for each said pixel value;

(c) specifying the pixels within each window;

(d) comparing for each window each pixel position to determine if the pixel is or is not within each window;

(e) performing a priority operation that determines, of the windows that contain the pixel, the window number having the highest priority; and (f) providing said determined window number to the pixel processing unit for controlling operations performed on the pixel value.

8. The method of claim 7 wherein a pixel that is not contained in any window is assigned a specified default window number.

9. A computer video graphics system for displaying on a monitor pixels belonging to overlapping windows, comprising:

a. a pixel value memory containing pixel values to be displayed on the monitor;

b. means for sequentially and continuously reading the pixel value memory in the order in which pixel values are contained within the pixel value memory;

c. means for assigning a priority to each window to be displayed;

d. a set of registers for storing the locations of the edges of each window;

e. a set of counters for tracking the pixel being displayed at any time;

f. comparators for comparing the contents of the counters with the contents of the registers and producing a bit for each pixel that is within a window; and g. an arbitrator for selecting the highest priority window of those for which a bit was produced by the comparator, whereby said pixel belongs to the highest priority window.

10. In a computer video graphics system having a pixel processing unit and a frame buffer with memory locations and which is capable of displaying pixels sequentially and continuously from the first memory location in the frame buffer to the last memory location in the frame buffer in a plurality of windows of selectable priority, a method of determining a window number for each pixel comprising the steps of:

a. sequentially and continuously obtaining pixel values from the first memory location in a frame buffer to the last memory location in the frame buffer;

(b) providing respective window numbers for each said pixel value;

(c) providing in registers the minimum and maximum extents of each window;

(d) performing a comparison operation in parallel for each window to determine if a pixel is or is not in that window;

(e) performing a priority operation that determines, of the windows that contain the pixel, the window number having the highest priority; and (f) outputting that number to the pixel processing unit for controlling operations performed on the pixel value.

11. An apparatus for specifying windows in priority order in a video graphics system, the windows comprising pixels and the video graphics system having a refresh process, the apparatus comprising:

a. a frame buffer with memory locations and which is capable of displaying pixels sequentially and continuously from the first memory location in the frame buffer to the last memory location in the frame buffer in a plurality of windows of selectable priority;

b. an X counter and a Y counter for calculating the X,Y position of refresh logic in the video graphics system;

c. a set of window definition registers coupled to the X and Y counters for storing the locations of the edges of the windows defined in the system;

d. a set of window detectors for receiving a window definition for each X,Y position from the X and Y counters contained within a window;

e. a priority tree for determining which of the windows containing each pixel has highest priority, the priority tree outputting a window number for each X,Y position within a window in the refresh process and for each X,Y position that is not within a window, outputting a default window number;

f. a mapping memory for receiving each window number from the priority tree; and g. means for receiving pixel values from the frame buffer in the order in which the pixel values are stored in the frame buffer, each pixel value received having a corresponding window number received by the mapping memory.

12. A method of specifying windows in priority order in a video graphics system having a frame buffer for storing pixel values, the windows comprising pixels and the video graphics system having a refresh process, comprising the steps of:

a. calculating the X,Y position of refresh logic in the video graphics system in a set of X and Y counters;

b. storing the locations of the edges of the windows defined in the system in a set of window definition registers coupled to the X and Y counters;

c. receiving a window definition in a set of window detectors for each X,Y position in the X and Y counters contained within a window;

d. determining in a priority tree which of the windows containing each pixel has highest priority, the priority tree outputting a window number for each X,Y position within a window in the refresh process and for each X,Y position that is not within a window, outputting a default window number;

e. receiving in a mapping memory each window number from the priority tree; and f. receiving pixel values sequentially and continuously from the first pixel value in the frame buffer to the last pixel value in the frame buffer in the order in which the pixel values are stored in the frame buffer, each pixel value received having a corresponding window number received by the mapping memory.

* * * * *